US006071470A

United States Patent [19]

Koizumi et al.

[11] Patent Number: 6,071,470

[45] **Date of Patent: *Jun. 6, 2000**

[54] REFRACTORY SUPERALLOYS

[75] Inventors: Yutaka Koizumi; Yoko Yamabe; Yoshikazu Ro; Tomohiro Maruko; Shizuo Nakazawa; Hideyuki Murakami; Hiroshi Harada, all of Tsukuba, Japan

[73] Assignee: National Research Institute For Metals, Ibaraki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/616,198

[22] Filed: Mar. 15, 1996

[51] Int. Cl.[7] ..... C22C 27/00

[52] U.S. Cl. ..... 420/461; 420/462; 148/400; 148/405

[58] Field of Search ..... 420/461, 462; 148/405, 400; C22C 27/00

[56] References Cited

U.S. PATENT DOCUMENTS 3,918,965 11/1975 Inouye et al. ..... 420/461
5,080,862 1/1992 Luthra ..... 420/461
5,234,774 8/1993 Hasegawa et al. ..... 420/461

FOREIGN PATENT DOCUMENTS 04149082 5/1992 Japan .
05331394 12/1993 Japan .

OTHER PUBLICATIONS

Binary Alloy Phase Diagrams V2 ed by Thaddeus Massalski; Jun. 1987; pp. 1423–1424, 1430–1441, 1689, 1691, 1975, 1977, 1979–1981; 85 1986.

*Primary Examiner*—Deborah Yee
*Attorney, Agent, or Firm*—Wenderoth, Lind & Ponack, L.L.P.

[57] ABSTRACT

Refractory superalloys consist essentially of a primary constituent selected from the group consisting of iridium, rhodium, and a mixture thereof, and one or more additive elements selected from the group consisting of niobium, tantalum, hafnium, zirconium, uranium, vanadium, titanium and aluminum, and the superalloys having a microstructure containing an FCC-type crystalline structure phase and an $L1_2$-type crystalline structure phase are precipitated. Preferably the amount of additive element(s) is 2 to 22 atom %.

1 Claim, 1 Drawing Sheet

REFRACTORY SUPERALLOYS

FIELD OF THE INVENTION

The present invention relates to refractory superalloys. More particularly, the present invention relates to superalloys as a heat-resisting material appropriate for a turbine blade or vane provided with a power-generation gas turbine, a jet engine or a rocket engine.

DESCRIPTION OF THE PRIOR ART

Ni-base superalloys have conventionally been applied to heat-resisting members provided with such a high-temperature appliance as a turbine blade or vane. These Ni-base superalloys have a melting point of around 1,300° C., and therefore, the upper limit of a temperature range in which these superalloys have sufficient practical strength is at best about 1,100° C. In order to improve the generated output and thermal efficiency of the high-temperature appliance, it is obligatory to raise the gas combustion temperature. The upper limit for a practicable temperature range should also be upgraded higher than 1,100° C. for the Ni-base superalloys. A material having a more excellent heat-resisting performance should be developed to upgrade such upper limit.

Conventional alloys containing tungsten, niobium, molybdenum or tantalum have been studied to realize such a property, but these alloys have a decisive defect in that they are apt to disappear by rapid oxidation in such an oxidative atmosphere as air and a combustion gas, though they show sufficient high-temperature strength in non-oxidative atmosphere as in vacuum or in an inert gas. It cannot be possible that these alloys are applied to structural members of the high-temperature appliance.

The present invention has an object to provide refractory superalloys whose upper limit of a temperature range is higher than that of the conventional alloys and is appropriate for practical use.

The present invention also has an object to provide refractory superalloys greatly improved in oxidation resistance.

These and other objects, features and advantages of the invention will become more apparent upon reading the following detailed specification and drawing.

EMBODIMENTS

Figure 1:
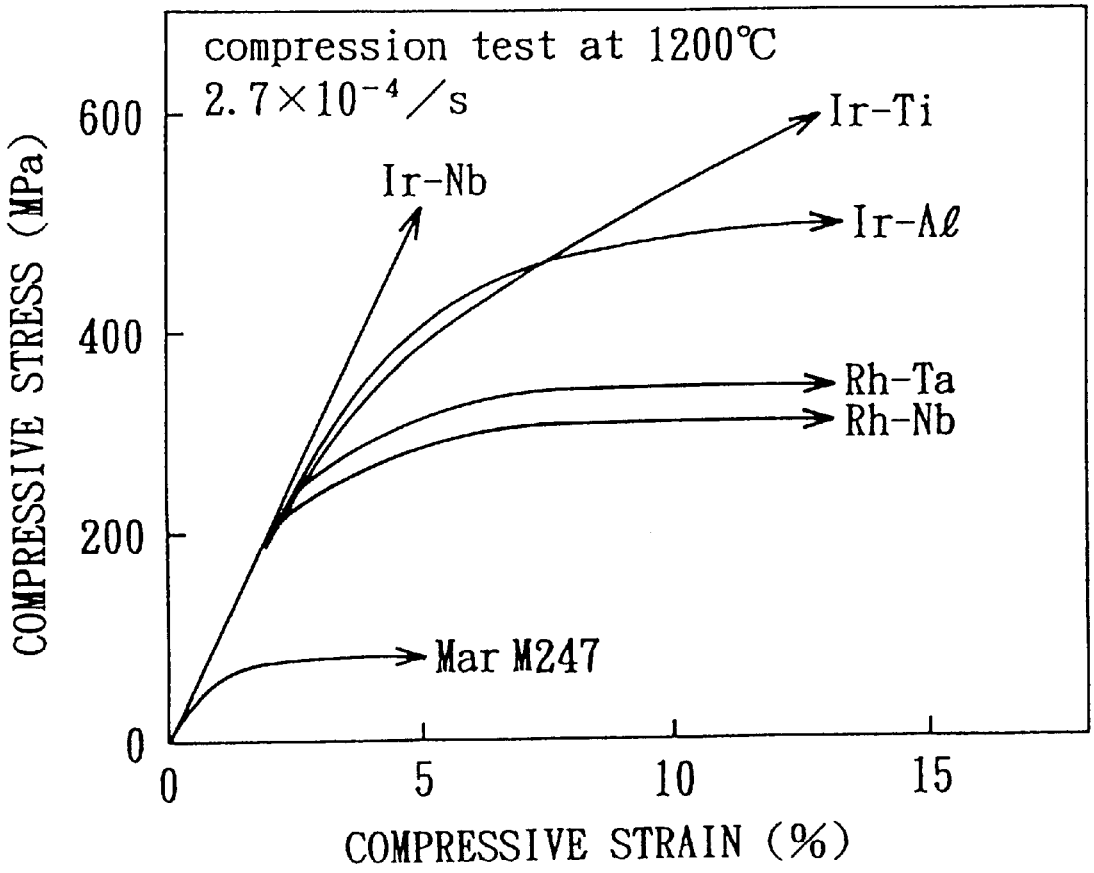
FIG. 1 depicts strain-stress curves of refractory superalloys of the present invention and a conventional superalloy.

The present invention provides a refractory superalloy consisting essentially of a primary constituent selected from the group consisting of iridium, rhodium, and a mixture thereof, and one or more additive elements selected from the group consisting of niobium, tantalum, hafnium, zirconium, uranium, vanadium, titanium and aluminum, said refractory superalloy having a microstructure containing an FCC-type crystalline structure phase and an $L1_2$-type crystalline structure phase. In the present invention, solid solutions of iridium and rhodium are involved in the category of the mixture.

The present invention also provides refractory superalloys containing said one or more additive element in a total amount of within a range of from 2 atom % to 22 atom %.

Refractory superalloys which meet the required performance, i.e., high-temperature strength and oxidation resistance are realized by adding one or more additive elements such as niobium, tantalum, hafnium, zirconium, uranium, vanadium, titanium or aluminum to a primary contituent selected from the group consisting of iridium, rhodium, and a mixture thereof. Two crystalline phases, one of which is an FCC-type structure and the other an $L1_2$-type structure, are formed in these superalloys.

As these two crystalline phases are coherent with each other, the coherent interfaces between the phases come to prevent movement of dislocations and then high-temperature strength of the refractory superalloys reaches a maximum value. The refractory superalloys are, on the other hand, liable to become a single crystalline phase of the FCC-type structure in case that the total amount of the additive element(s) is below 2 atomic %. Likewise, the refractory superalloys turn into single-phase alloys consisting of the $L1_2$-type structure over 22 atomic %. The total amount of additive element(s) should, therefore, preferably fall in a range of from 2 atom % to 22 atom %.

It is possible that while the feature of the refractory superalloys in the crystalline structure is preserved, several properties including high-temperature strength and oxidation resistance are enhanced by adding some other elements.

For example, one or more reinforcing elements such as molybdenum, tungsten or rhenium may be added. This element is usually added to such a heat-resisting material as heat-resisting steels and Ni-base heat-resisting superalloys, and is known for a remarkable improvement in high-temperature strength. Partial replacement of iridium or rhodium with ruthenium, palladium, platinum or osmium may be effective for enhancement, of high-temperature strength. In the case that superalloys contain both iridium and rhodium as a primary constituent, it is possible to substitute all amounts of the primary constituent with palladium or platinum, although melting point of alloys may fall.

For the purpose of further improving both oxidation resistance and high-temperature corrosion resistance, one or more elements such as chromium or rhenium which, in general, has a good effect on the oxidation resistance of heat-resisting alloys may be added.

One or more elements such as carbon or boron may be added. This element is usually added to heat-resisting steels and Ni-base heat resisting superalloys because it promotes strength of grain boundaries of polycrystalline materials.

Partial substitution of iridium or rhodium with such an element as is inexpensive and has light weight, for example, nickel or cobalt, may make some contribution to reduction of price and specific gravity of the refractory superalloys.

For a manner of making these refractory superalloys, such a directional solidification, a single-crystal solidification method or a powder metallurgy, as is adopted to enhance strength of Ni-base heat-resisting superalloys may be applied to control a crystalline structure of the refractory superalloys.

In addition, such a solution treatment, an aging treatment, or a thermo mechanical treatment as is common in manufacturing two-phase alloys may be employed to develop properties of the refractory superalloys by controlling their microstructure. Superalloys which contain at least iridium, rhodium, or a mixture thereof as a primary consituent and have FCC-type and $L1_2$-type crystalline structure phases may possibly constitute a new alloy system which has never been known before.

Now, the present invention will be described further in detail by means of some examples. It is needless to mention that the present invention is not limited to these examples.

EXAMPLES

Each of niobium, titanium and aluminum in the amount of 15 atom % was added to each of iridium and rhodium. Alloys were prepared by an arc melting. The resultant five kinds of alloy were compared with MarM247, a conventional Ni-base superalloy in high-temperature strength. These five alloys were also compared in oxidation resistance with MarM247, pure iridium, a niobium alloy, a tantalum alloy, a molybdenum alloy and a tungsten alloy.

For high-temperature strength, compression tests were carried out in air both at 1,200° C. and at 1,800° C.

As is clear from FIG. 1, each refractory superalloy which contains iridium or rhodium as a primary element demonstrates a very high stress against deformation induced from outside. This fact makes it clear that the refractory superalloys are more excellent in strength than the conventional Ni-base superalloy.

Regarding oxidation resistance, oxidation losses at 1,500° C. for an hour were measured. Table 1 shows the amount of oxidation loss and 0.2% yield stress at 1,200° C. for each alloy. It is confirmed in Table 1 that the refractory superalloys of the present invention are excellent in oxidation resistance, while their strength is equal or superior to the conventional metals or alloys such as MarM247, pure iridium, a niobium alloy, a tantalum alloy, a molybdenum alloy, and a tungsten alloy.

TABLE 1

| Alloys | 1,200° C. 0.2% yield stress (MPa) | 1,800° C. 0.2% yield stress (MPa) | 1,500° C. 1 h oxidation loss |
|---|---|---|---|
| <New alloys> | | | |
| Ir-15% Al | 350 | — | 0.25% |
| Ir-15% Ti | 310 | 221.7 | 0.62 |
| Ir-15% Nb | more than 502 | 212.3 | 0.65 |
| Rh-15% Nb | 240 | — | 0.04 |
| Rh-15% Ta | 260 | — | 0.06 |
| <Conventional alloys> | | | |
| MarM247 (Ni-base superalloy) | 55 | melted | melted |
| Pure Jr | 170* | 20.3 | 0.54 |
| FS-85(Nb alloy) | 190* | 39 | 100 |
| Mo-50Re(Mo alloy) | 290* | — | 100 |
| T-222(Ta alloy) | 370* | 94 | 100 |
| W-25Re(W alloy) | 385* | 133 | 100 |

*From literature

What is claimed is:

1. A refractory superalloy selected from the group consisting of Ir-15at % Al, Ir-15at % Ti, Ir-15at % Nb, Rh-15at % Nb and Rh-15at % Ta, said refractory superalloy having a microstructure containing an FCC crystalline structure phase and an $L1_2$ crystalline structure phase.

* * * * *